US011300374B1

(12) United States Patent
Tritsch

(10) Patent No.: US 11,300,374 B1
(45) Date of Patent: Apr. 12, 2022

(54) BOLT ASSEMBLY FOR A FIREARM

(71) Applicant: Zermatt Arms, Inc., Bennet, NE (US)

(72) Inventor: Aaron M. Tritsch, Bennet, NE (US)

(73) Assignee: Zermatt Arms, Inc., Bennet, NE (US)

( * ) Notice: Subject to any disclaimer, the term of this patent is extended or adjusted under 35 U.S.C. 154(b) by 0 days.

(21) Appl. No.: 17/151,206

(22) Filed: Jan. 17, 2021

Related U.S. Application Data

(60) Provisional application No. 62/962,993, filed on Jan. 18, 2020.

(51) Int. Cl.
*F41A 15/14* (2006.01)
*F41A 3/22* (2006.01)
*F41A 3/18* (2006.01)

(52) U.S. Cl.
CPC ..... *F41A 15/14* (2013.01); *F41A 3/18* (2013.01); *F41A 3/22* (2013.01)

(58) Field of Classification Search
CPC ..... F41A 3/16; F41A 3/18; F41A 3/20; F41A 3/22; F41A 15/12; F41A 15/14; F41A 15/16
See application file for complete search history.

(56) References Cited

U.S. PATENT DOCUMENTS 1,423,836 A * 7/1922 Declaye ..... F41A 15/14 89/4.5
1,672,540 A * 6/1928 Page ..... F41A 15/14 42/25
3,021,634 A * 2/1962 Johnson ..... F41A 15/14 42/25
3,906,651 A * 9/1975 Vesamaa ..... F41A 15/14 42/25
4,930,238 A * 6/1990 Poff, Jr. ..... F41A 3/22 42/16
2020/0033082 A1* 1/2020 Bush ..... F41A 3/22

* cited by examiner

*Primary Examiner* — Gabriel J. Klein
(74) *Attorney, Agent, or Firm* — Lightfoot & Alford PLLC

(57) ABSTRACT

A bolt assembly for a rimmed-cartridge firearm has a bolt head on a forward end. An extractor is located on the bolt head and engages at least a portion of a rim of a rimmed cartridge without engaging a front surface of the rim. A biased tensioner is also located on the bolt head and angularly spaced about the bolt head from the extractor, the tensioner applying force to the rim without engaging a front surface of the rim. The extractor and tensioner cooperate for retaining the rim adjacent the bolt head.

18 Claims, 10 Drawing Sheets

BOLT ASSEMBLY FOR A FIREARM

CROSS-REFERENCE TO RELATED APPLICATIONS

This patent application claims the benefit of the filing date of U.S. Provisional Patent Application Ser. No. 62/962,993, filed on 18 Jan. 2020 and entitled "BOLT ASSEMBLY FOR A FIREARM," the entire content of which is hereby expressly incorporated by reference.

BACKGROUND

A firearm bolt is configured for retaining a cartridge within a chamber during firing of the cartridge. Previous bolts have an extractor extending forward of the bolt for engaging a rim or groove on the cartridge case and allow for the case to be extracted from the chamber when the bolt is moved rearward. This configuration requires a relief cut in the barrel to allow for the forward face of the bolt to abut the barrel.

DETAILED DESCRIPTION

In the specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges a new bolt assembly for firearms, the bolt assembly having a bolt head with a flat forward face for mating with a flat breech face of a barrel. The bolt head comprises an extractor and a tensioner, neither of which protrude forward of the forward face, thereby eliminating the need for one or more recesses cut into a flat breech face at the rear end of a barrel. The extractor contacts only an outside circumferential portion of the case rim and does not contact a forward-facing surface of the rim. The bolt assembly may be configured for use with rimfire cartridges or other types of rimmed cartridges, including centerfire cartridges, which typically rely on the case rim for headspacing a cartridge.

Figure 1:
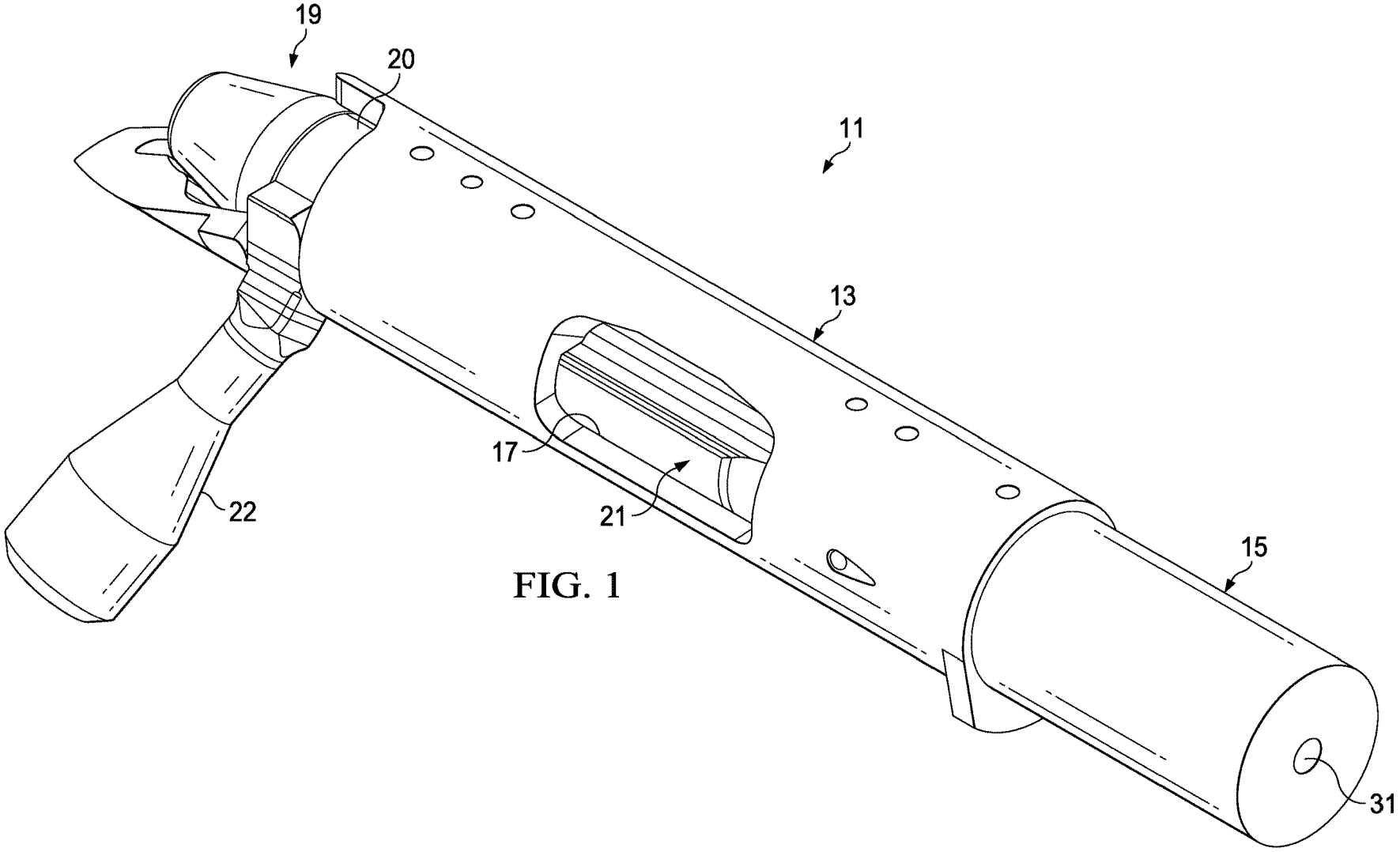
FIG. 1 illustrates a firearm having a receiver and barrel assembly, a bolt assembly according to this disclosure being installed in the receiver.
Figure 2:
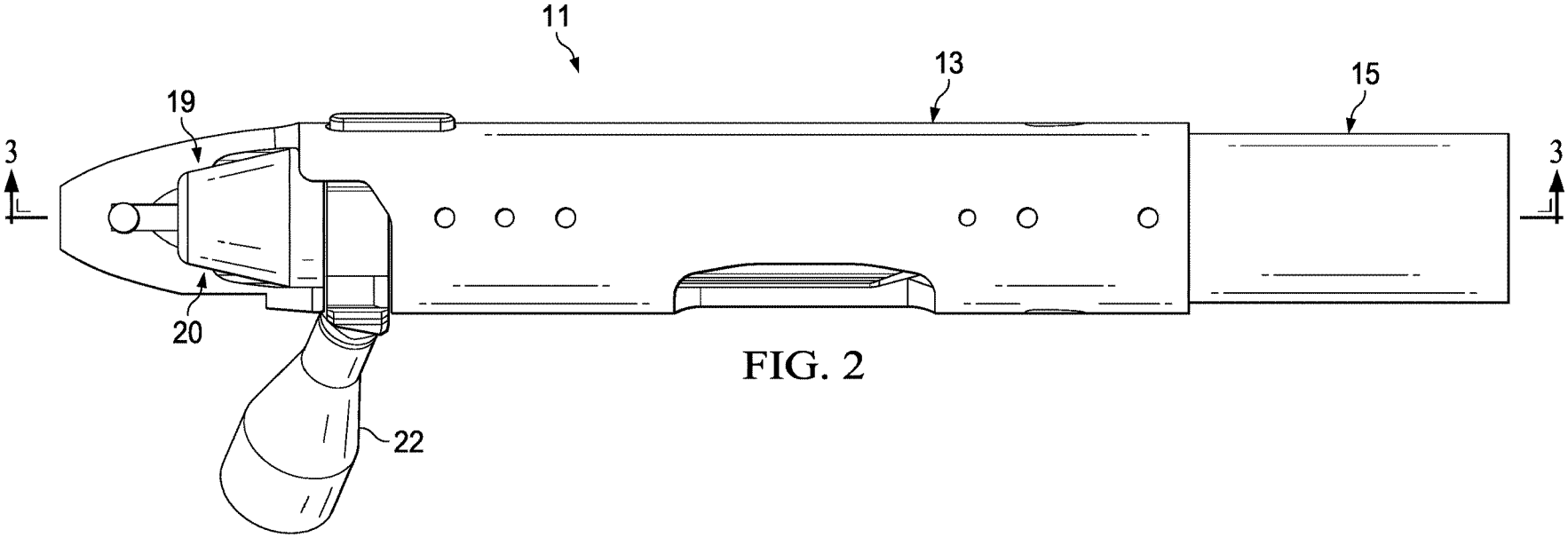
FIG. 2 is a plan view of the firearm of FIG. 1.
Figure 3:
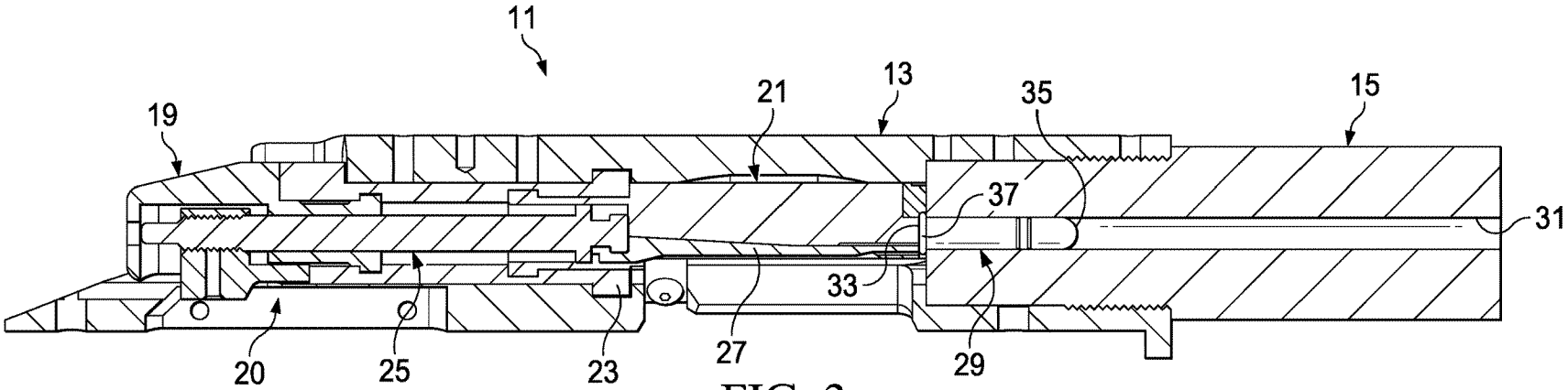
FIG. 3 is a right-side section view of the firearm of FIG. 1 along the 3-3 section plane shown in FIG. 2.
Figure 4A:
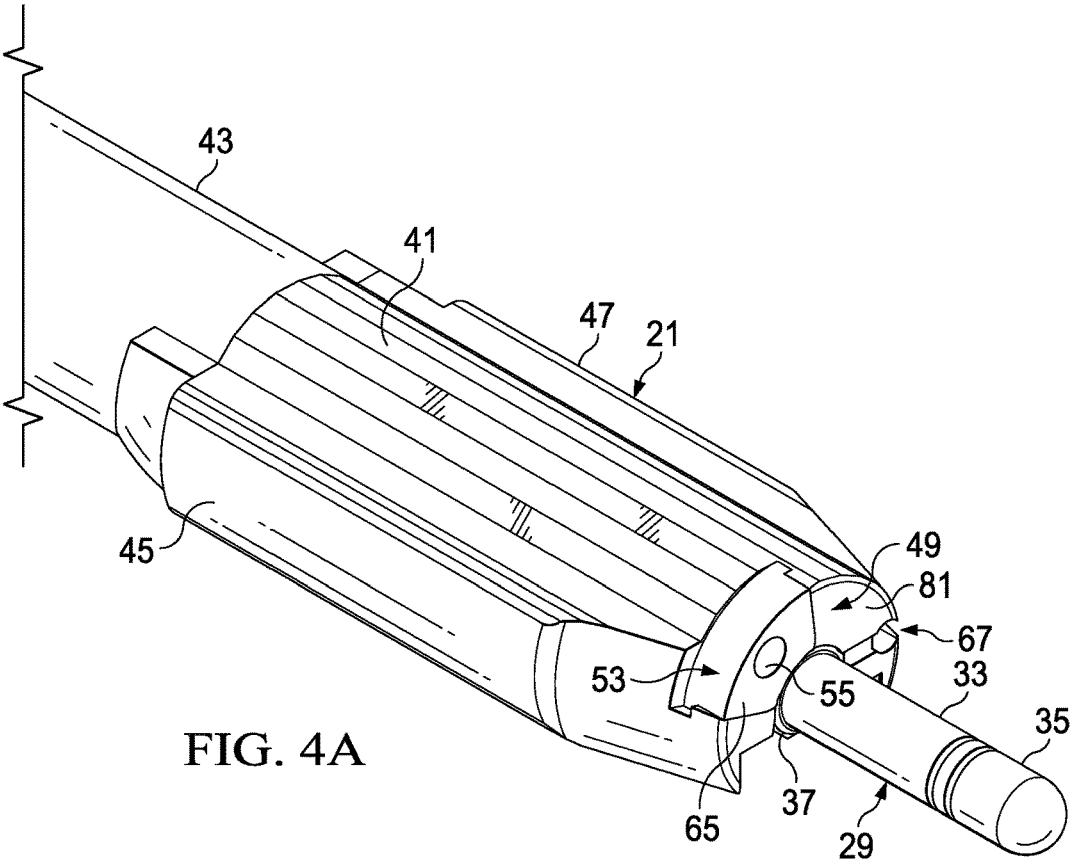
FIGS. 4A and 4B are oblique views of a bolt head according to this disclosure, a cartridge being retained adjacent the bolt head.
Figure 4B:
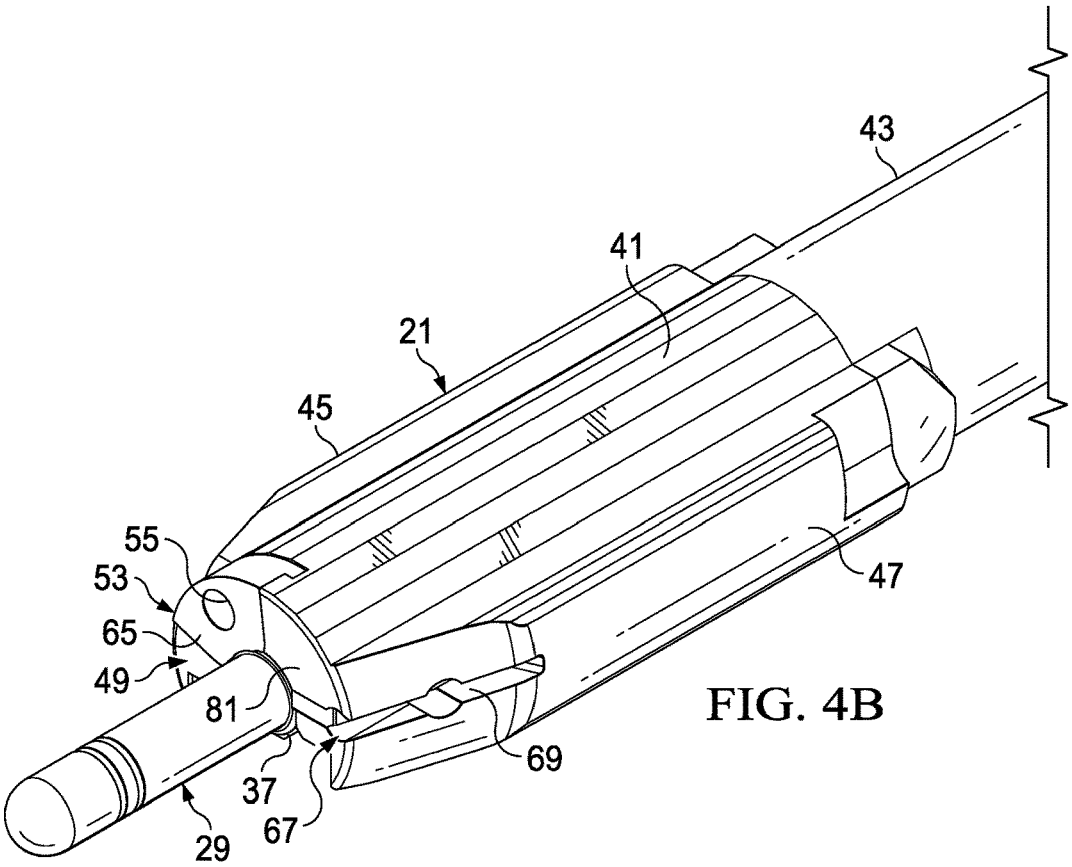
Figure 5A:
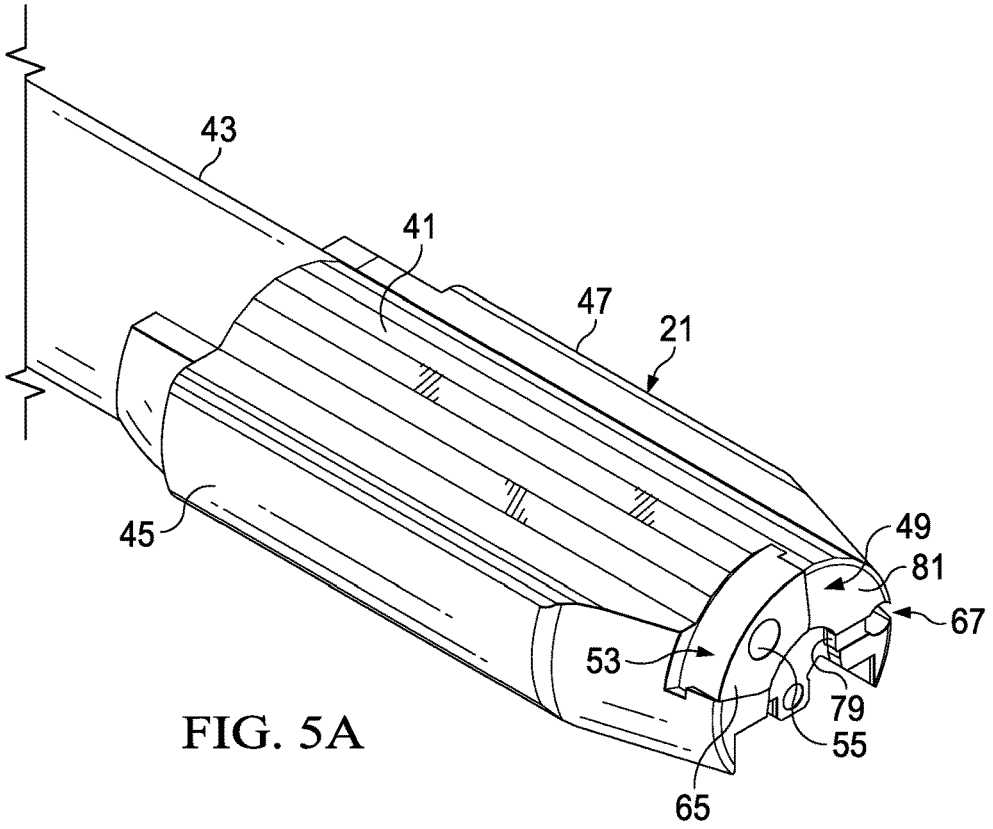
FIGS. 5A through 5D are oblique views of a bolt head according to this disclosure.
Figure 5B:
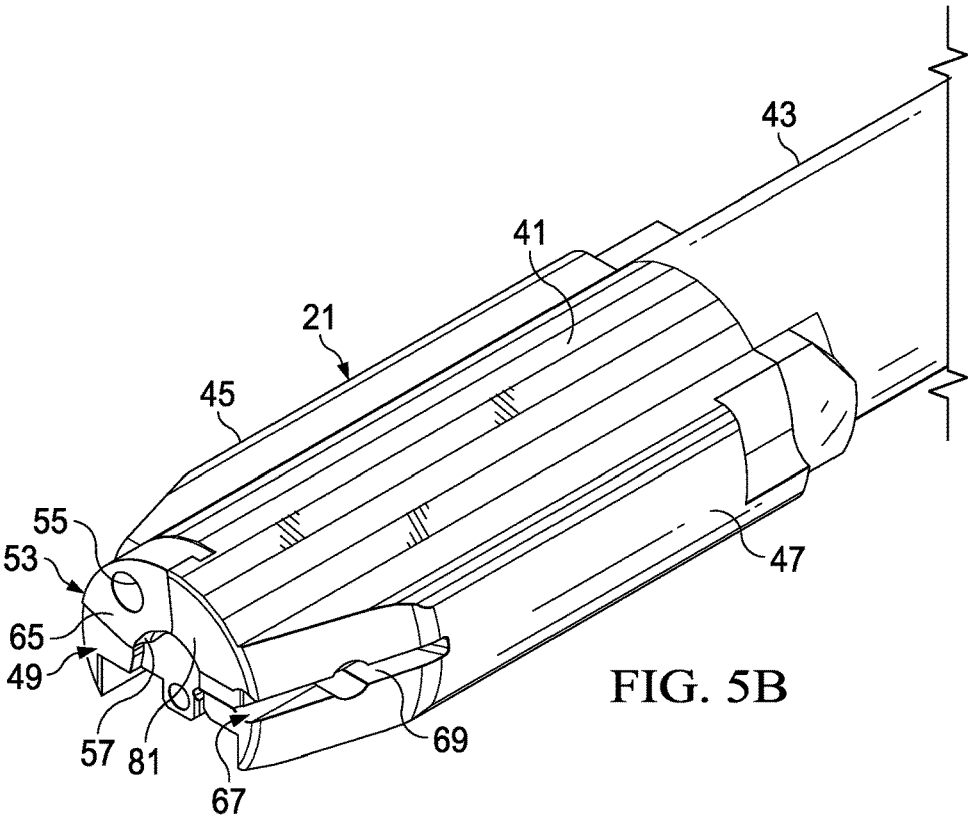
Figure 5C:
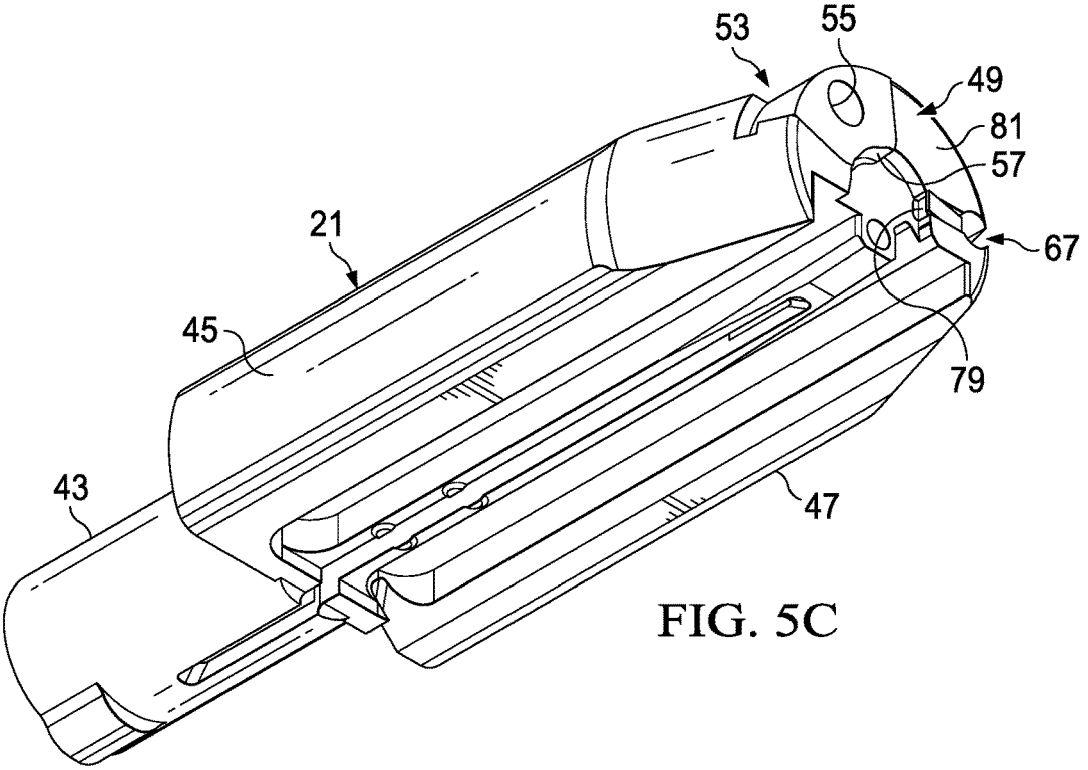
Figure 5D:
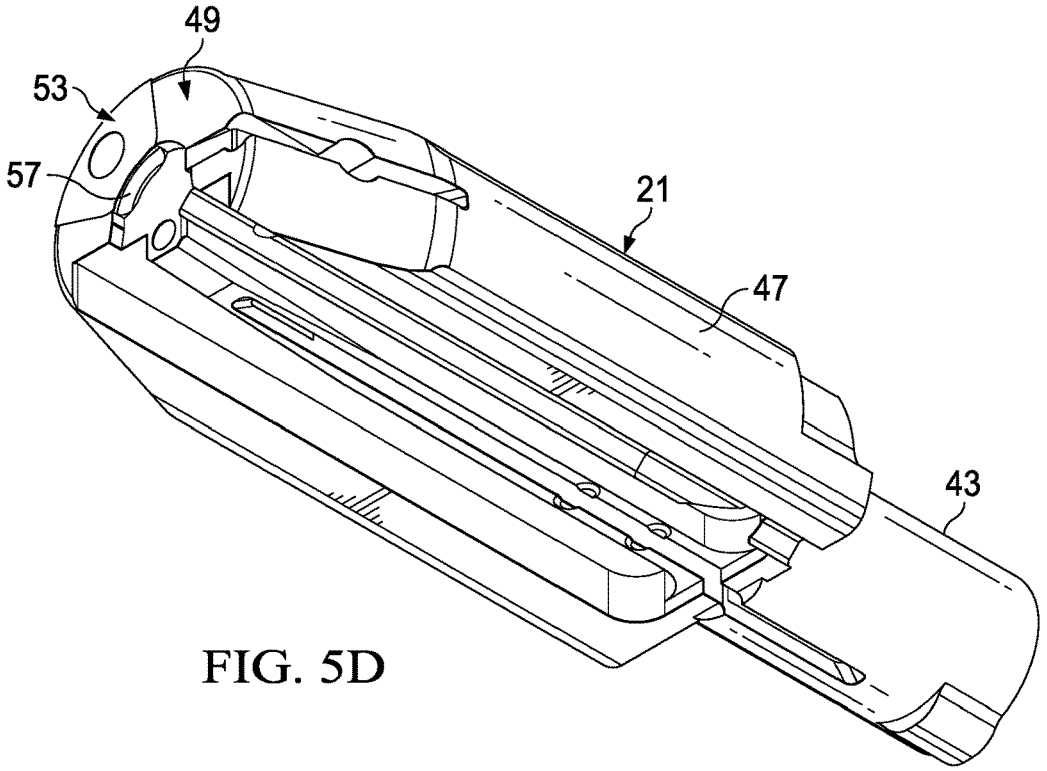
Figure 6:
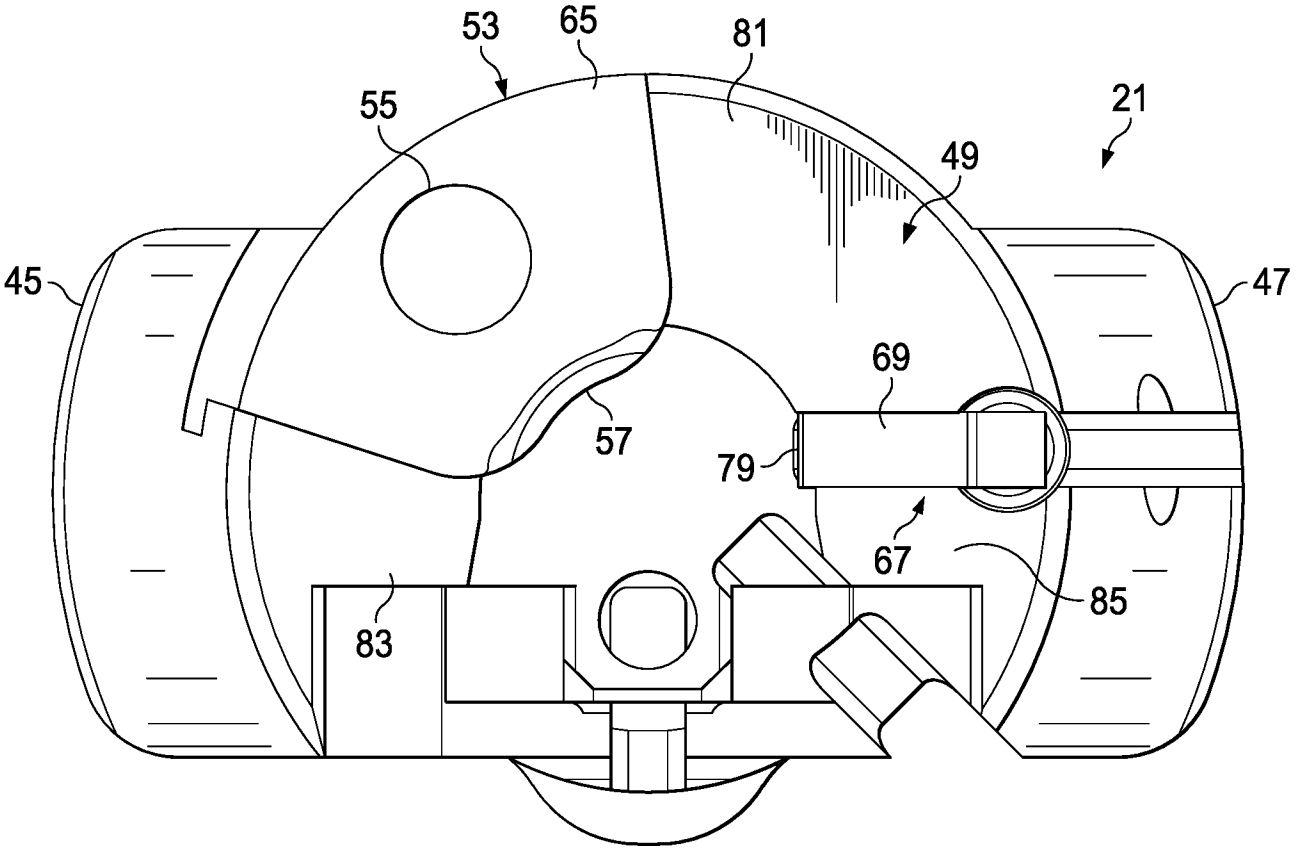
FIG. 6 is a front end view of the bolt head of FIG. 4.
Figure 7:
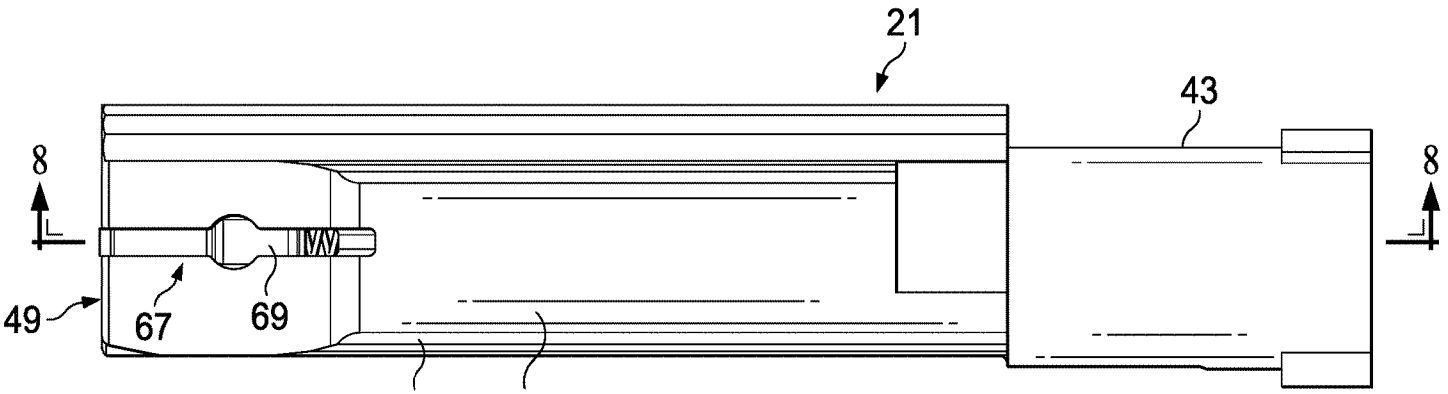
FIG. 7 is a left side view of the bolt head of FIG. 4.
Figure 8:
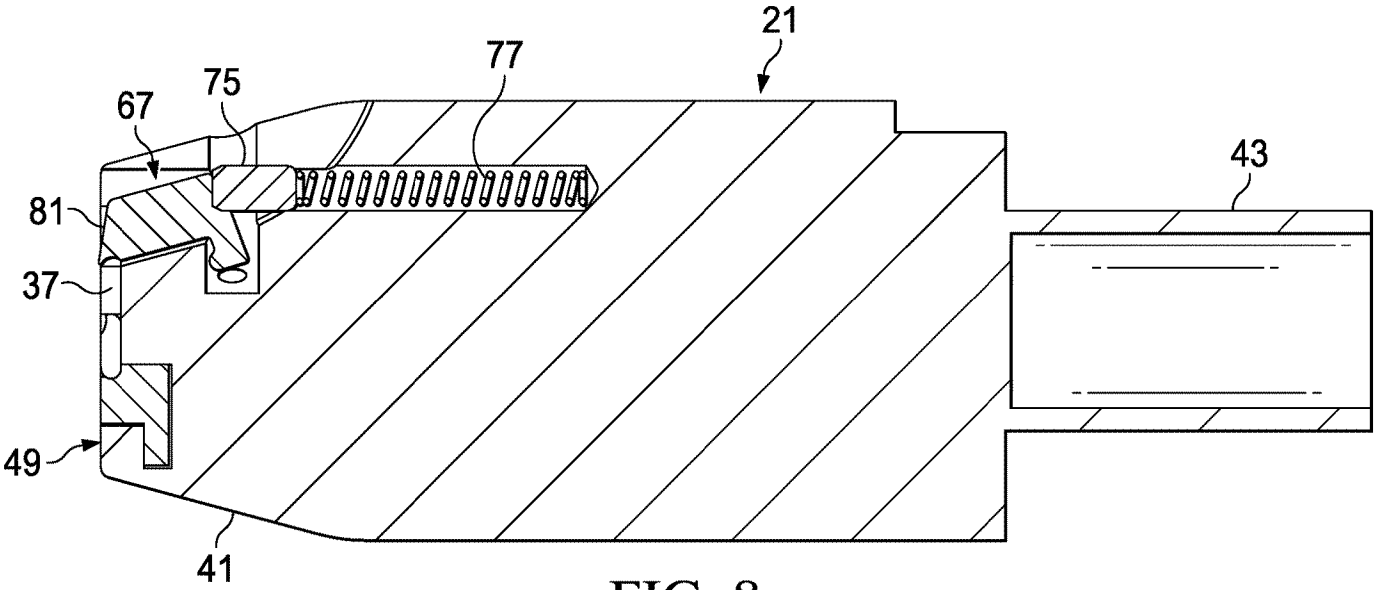
FIG. 8 is a cross-section view along the 8-8 section plane shown in FIG. 7.
Figure 9:
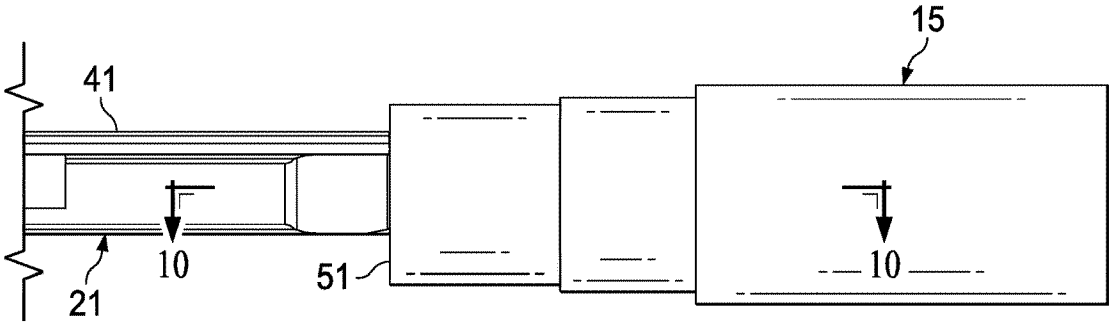
FIG. 9 is a right side view of the bolt head of FIGS. 4A and 4B mated with the barrel of FIG. 1.

FIGS. 1 through 3 illustrate a firearm 11, comprising a receiver 13 and a barrel 15 coupled to a forward end of receiver 13. Receiver 13 is generally cylindrical and has a tubular passage 17 formed therein for receiving a bolt assembly 19. Receiver 13 is typically configured for installation in a rifle stock (not shown) for shouldering during use, though receiver 13 may alternatively be configured for use in a handgun or in a fixed configuration, such as for proof or accuracy testing.

In the embodiment shown, bolt assembly 19 comprises a bolt 20 and a bolt head 21, and bolt assembly 19 is slidingly carried within passage 17 for coaxial translation therein. In operation, bolt handle 22 is rotated to engage or disengage locking lugs 23 of bolt 20 with corresponding recesses in receiver 13. A firing mechanism 25 is housed within bolt 20 for selectively causing a firing pin 27 to strike the rear of a cartridge 29 loaded in a rearward chamber portion of bore 31 of barrel 15. Cartridge 29 comprises a case 33 and a bullet 35 loaded in a forward end of case 33. Case 33 comprises a rim 37 at the rear end of case 33, rim 37 having a diameter larger than the sidewall of case 33.

FIGS. 4A through 11 illustrate components and operation of bolt head 21. Bolt head 21 is rotatably coupled to a forward end of bolt 20 for translation therewith in passage 17. Bolt head 21 comprises a body 41 and a tail portion 43 received within a corresponding aperture in the forward end of bolt 20, thereby allowing for relative rotation between bolt head 21 and bolt 20. Body 41 comprises sliding lugs 45, 47 formed on opposite sides of body 41 and configured for engaging corresponding grooves in receiver 13 and maintaining bolt head 21 in a selected angular orientation within receiver 13 when bolt 20 is rotated.

Figure 10:
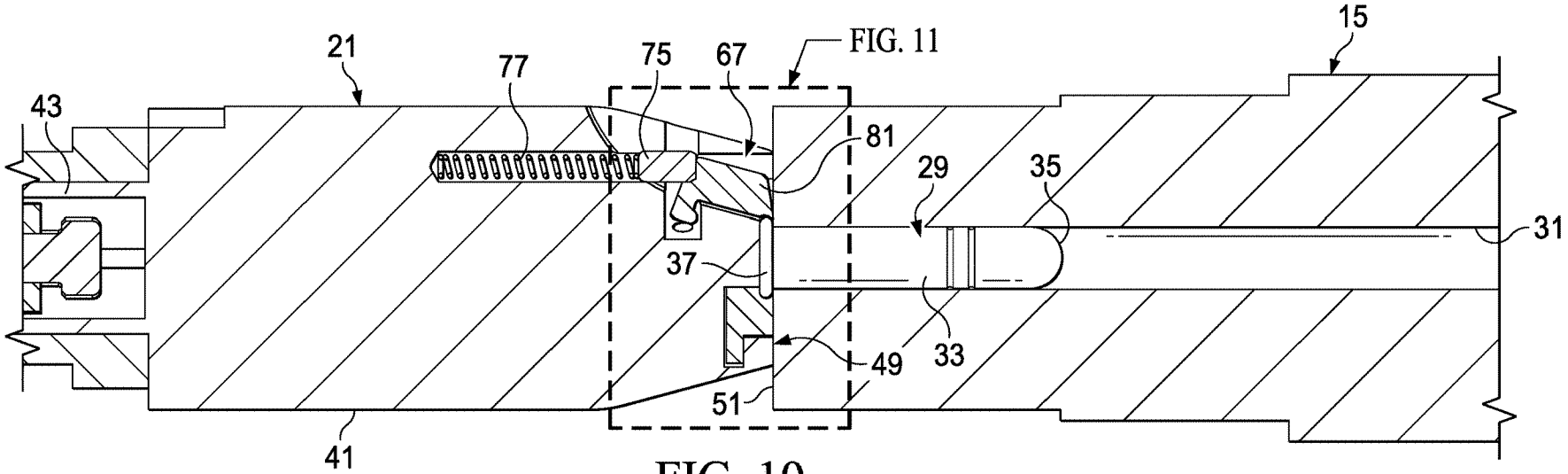
FIG. 10 is a cross-section view along the 10-10 section plane shown in FIG. 9.
Figure 11:
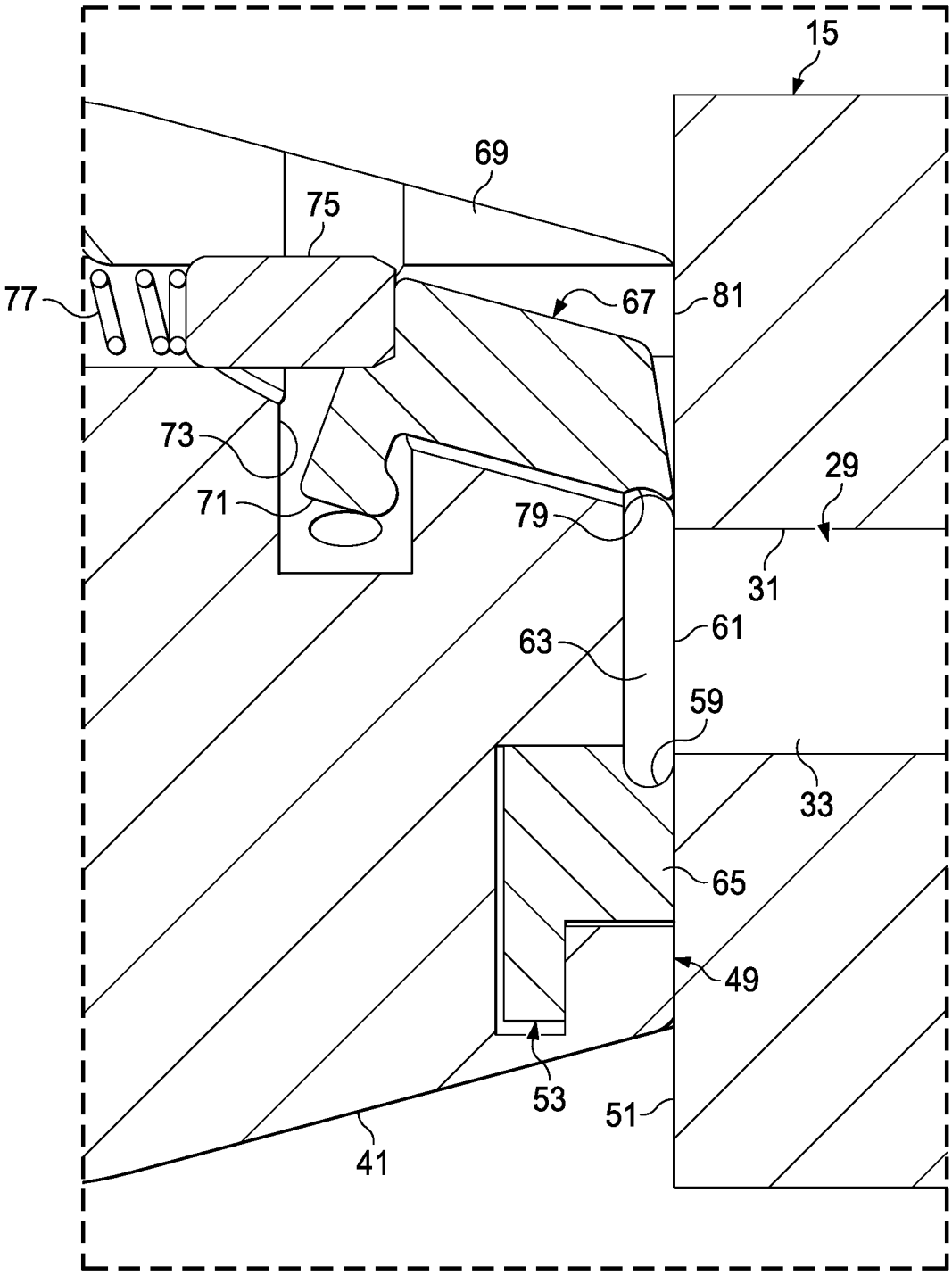
FIG. 11 is an enlarged view of a portion of FIG. 10.

Bolt head 21 features an extractor system that allows for a flat nose 49 for mating with a flat rear breech face 51 of barrel 15 when bolt assembly 19 is locked forward in the closed position, and this is most easily viewed in FIGS. 10 and 11. This allows for use of barrel 15 without the need to provide relief cuts in breech face 51 for receiving an extractor or other components extending forward of nose 49.

An extractor 53 is fixedly coupled to the forward end of body 41 with a fastener 55 and comprises an arcuate extractor claw 57 positioned on a radially inward portion for engaging rim 37 of case 33. As shown most clearly in FIGS. 5D and 11, claw 57 has an inner surface 59 with a correspondingly arcuate or U-shaped cross-section for receiving the rounded circumferential surface of rim 37 without contacting forward surface 61 of rim 37. The rear portion of claw 57 may extend radially inward and engage rearward surface 63 of rim 37. This configuration allows claw 57 to extract case 33 from within bore 31 without the need for extractor 53 to extend forward of breech face 51 of barrel 15. In the embodiment shown, a forward face 65 of extractor 53 is coplanar with nose 49 and abuts breech face 51 when bolt head 21 is in the closed position, though forward face 65 may alternatively be located slightly rearward of nose 49. Surface 59 is configured to engage a sufficient angular portion of rim 37 to ensure successful extraction, but surface 59 does not engage enough of rim 37 to interfere with pivoting of case 33 relative to extractor 53 during ejection. For example, in the preferred embodiment surface 59 engages 60 degrees of rim 37, though other embodiments can engage more or less of rim 37. It should also be noted that claw 57 may have alternative configurations, such as, for example, with inner surface 59 having a different cross-sectional shape or claw 57 being formed as having multiple separate fingers engaging rim 37.

To maintain engagement of rim 37 with extractor 53, a tensioner 67 is pivotally carried within a radial slot 69 formed in a forward end of body 41 and angularly spaced about bolt head 21 from extractor 53. In the embodiment shown, tensioner 67 comprises a hook 71 that engages an inner wall of a hole 73 formed in slot 69, allowing tensioner 67 to rotate on hook 71. Tensioner 67 is biased by a dowel 75 and spring 77 for causing an inner surface 79 to engage the rounded circumferential surface of rim 37 without contacting forward surface 61 of rim 37, thereby applying force on rim 37 for causing rim 37 to remain engaged with extractor 53. In this embodiment, inner surface 79 of tensioner 67 has a correspondingly arcuate or U-shaped cross-section, like inner surface 59 of extractor 53, for receiving the rounded circumferential surface of rim 37. During operation, all of tensioner 67 remains rearward of breech face 51 of barrel 15.

In the embodiment shown, when bolt assembly 19 is in the closed position, forward face 65 of extractor 53 and forward faces 81, 83, 85 of body 41 form a forward end, or nose 49, of bolt head 21 and abut breech face 51 of barrel 15. As noted above, face 65 of extractor 53 may alternatively be located slightly rearward of faces 81, 83, 85.

Figure 12:
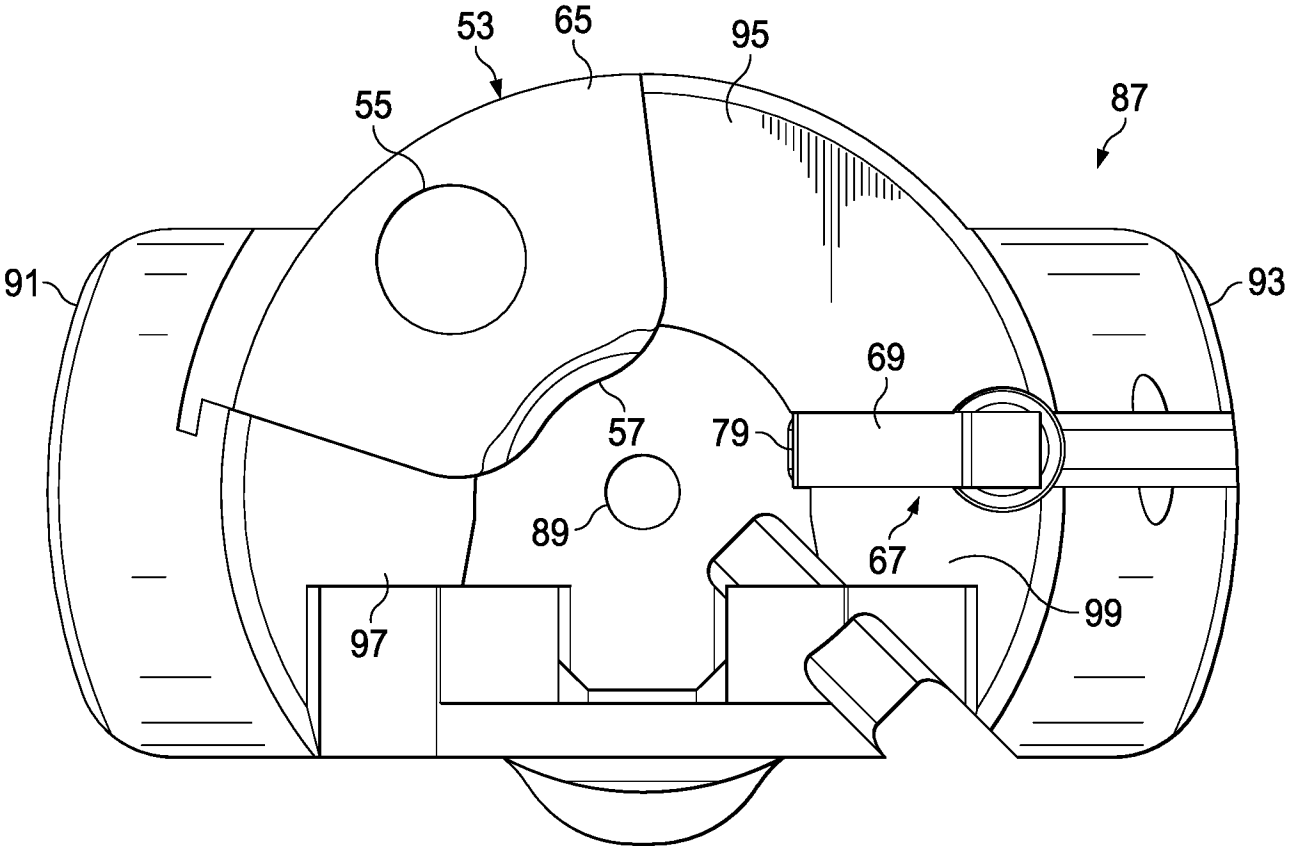
FIG. 12 is a front end view of an alternative embodiment of a bolt head according to this disclosure.

FIG. 12 illustrates a front end view of bolt head 87, which is an alternative embodiment of a bolt head according to this disclosure and configured for use with a bolt of a firearm. Bolt head 87 is constructed and operated similarly to bolt head 21, with identical features except for the placement of firing pin 89, which is positioned to accommodate a center-fire cartridge. Bolt head 87 comprises opposing sliding lugs 91, 93, extractor 53, and tensioner 67 and has a flat nose formed by surfaces 95, 97, 99.

Though shown as an assembly of a bolt and rotatable bolt head, embodiments according to this disclosure may comprise a one-piece bolt, such as may be used, for example, in a straight-pull bolt-action firearm. Also, the bolt head can be configured to allow slight movement of the extractor, which may accommodate varying rim diameters.

In addition, though the embodiments shown and described above include a flat nose and flat breech face that are both entirely flat, it should be noted that embodiments may include a ring on one (like a Remington 700 bolt face) and a relief on the other, or similar mating features, that surround the flat portions of the nose and breech face. These embodiments still provide for a flat nose that mates with a flat breech face without the need for an extractor relief cut in the breech face, which would be required to receive the portion of the extractor that protrudes from a typical bolt face.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. A bolt assembly for a rimmed-cartridge firearm, the bolt assembly comprising:
   - a bolt head having a forward end;
   - an extractor located on the bolt head and configured for engaging at least a portion of a rim of a rimmed cartridge without engaging a front surface of the rim; and
   - a biased tensioner located on the bolt head and angularly spaced about the bolt head from the extractor, the tensioner being configured for applying force to the rim without engaging a front surface of the rim;
   - wherein the extractor and tensioner are adapted to cooperate for retaining the rim adjacent the bolt head; and wherein no portion of the extractor extends forward of the forward end.

2. The assembly of claim 1, wherein no portion of the tensioner extends forward of the forward end.

3. The assembly of claim 1, wherein the forward end is flat.

4. The assembly of claim 1, wherein the bolt head is coupled to a bolt.

5. The assembly of claim 1, wherein the bolt head is rotatably coupled to a bolt.

6. The assembly of claim 1, wherein the extractor comprises an arcuate recess configured for engaging the rim.

7. The assembly of claim 1, wherein the tensioner comprises an arcuate recess configured for engaging the rim.

8. The assembly of claim 1, wherein the bolt head is configured for retaining the rim rearward of the forward end.

9. A bolt and barrel assembly for a firearm, the assembly comprising:
   - a barrel with a flat breech face without an extractor relief cut and a chamber configured for receiving a rimmed cartridge;

a bolt with a bolt head having a flat forward end configured for mating with the breech face;

an extractor located on the bolt head and configured for engaging at least a portion of a rim of a rimmed cartridge without engaging a front surface of the rim; and a biased tensioner located on the bolt head and angularly spaced about the bolt head from the extractor, the tensioner being configured for applying force to the rim without engaging a front surface of the rim;

wherein the extractor and tensioner are adapted to cooperate for retaining the rim adjacent the bolt head.

10. The assembly of claim 9, wherein no portion of the extractor extends forward of the forward end.

11. The assembly of claim 9, wherein no portion of the tensioner extends forward of the forward end.

12. The assembly of claim 9, wherein the bolt head is rotatably coupled to the bolt.

13. The assembly of claim 9, wherein the extractor comprises an arcuate recess configured for engaging the rim.

14. The assembly of claim 9, wherein the tensioner comprises an arcuate recess configured for engaging the rim.

15. The assembly of claim 9, wherein the bolt head is configured for retaining the rim rearward of the forward end.

16. A firearm, comprising:

a barrel with a flat breech face having a chamber configured for receiving a rimmed cartridge;

a bolt with a bolt head having a flat forward end configured for mating with the breech face;

an extractor located on the bolt head and configured for engaging at least a portion of a rim of a rimmed cartridge without engaging a front surface of the rim; and a biased tensioner located on the bolt head and angularly spaced about the bolt head from the extractor, the tensioner being configured for applying force to the rim without engaging a front surface of the rim;

wherein the extractor and tensioner are adapted to cooperate for retaining the rim adjacent the bolt head; and wherein no portion of the extractor extends forward of the forward end.

17. The firearm of claim 16, wherein no portion of the tensioner extends forward of the forward end.

18. The firearm of claim 16, wherein the bolt head is rotatably coupled to the bolt.

* * * * *